US005377085A

United States Patent [19]

Hermann et al.

[11] Patent Number: 5,377,085

[45] Date of Patent: Dec. 27, 1994

[54] ENCLOSED LIGHTED LAP-DESK

[76] Inventors: William A. Hermann; Nancy C. Hermann, both of 7216 E. 65th St., Tulsa, Okla. 74133

[21] Appl. No.: 941,679

[22] Filed: Sep. 8, 1992

[51] Int. Cl.[5] ..... A61G 13/00

[52] U.S. Cl. ..... 362/33; 362/97; 362/253; 108/23

[58] Field of Search ..... 362/33, 97, 98, 99, 362/190, 253; 108/43, 23; 248/444, 444.1

[56] References Cited

U.S. PATENT DOCUMENTS

| | | | |
|---|---|---|---|
| D. 278,918 | 5/1985 | Morcheles | D19/52 |
| 992,222 | 5/1911 | Maben | 362/98 |
| 1,320,840 | 11/1919 | Campbell | 108/43 |
| 1,767,156 | 6/1930 | Smith . | |
| 1,818,855 | 8/1931 | Kroldrup . | |
| 1,969,306 | 8/1934 | Hunter | 240/2.17 |
| 1,985,335 | 12/1934 | Bloss | 240/6.4 |
| 2,104,223 | 1/1938 | Feinberg | 240/2 |
| 2,501,840 | 3/1950 | Bradford | 40/86 |
| 2,685,638 | 8/1954 | Littrell | 240/6.4 |
| 2,783,109 | 2/1957 | Frey | 108/43 |
| 2,926,593 | 3/1960 | Bills | 95/102 |
| 3,885,145 | 5/1975 | Wise | 240/6.4 B |
| 4,254,449 | 3/1981 | Benasutti et al. | 362/33 |
| 4,290,093 | 9/1981 | Thompson et al. | 362/98 |
| 4,445,728 | 5/1984 | Bratton | 108/43 |
| 4,564,886 | 1/1986 | Morcheles | 362/97 |
| 4,700,634 | 10/1987 | Mills et al. | 108/43 |
| 4,751,620 | 6/1988 | Wright et al. | 362/99 |
| 4,765,583 | 8/1988 | Tenner | 108/43 |
| 4,795,210 | 1/1989 | Milat | 108/43 |
| 4,896,252 | 1/1990 | Stewart | 362/98 |
| 4,908,742 | 3/1990 | Kersey | 362/156 |
| 5,149,184 | 9/1992 | Hughes et al. | 362/33 |

*Primary Examiner*—Ira S. Lazarus
*Assistant Examiner*—Y. Quach
*Attorney, Agent, or Firm*—Catalano, Zingerman & McKay

[57] ABSTRACT

An enclosed, portable, lighted lap-desk is provided to facilitate reading or writing at night while the rays from the light are confined within the enclosure so as not to disturb others. The invention is particularly suited for use by a passenger in a motor vehicle traveling at night to provide light for reading or writing without interfering with the vision of the driver.

7 Claims, 3 Drawing Sheets

ENCLOSED LIGHTED LAP-DESK

BACKGROUND OF THE INVENTION

1. Field of the Invention

This invention relates to a lighted lap-desk and, more particularly, to a lighted lap-desk with a cover which confines the light to the work area of the lap-desk.

2. Background

A passenger traveling in a motor vehicle such as an automobile for a long time period often reads or writes. A commercial lap-desk can provide a work area suitable for reading or writing. When traveling at night, the passenger needs a light to illuminate the reading material or writing surface. Using the interior light of the vehicle while traveling at night is undesirable because the light reflects off the interior glass of the vehicle, inhibiting the vision of the driver.

U.S. Pat. No. 4,290,093, Thompson et al., describes a case for holding an open magazine. The case has a cover with a light for illuminating the magazine and a hood which shields the light from direct view by the magazine reader.

U.S. Pat. No. 4,700,634, Mills et al., describes a portable, lap-oriented desk unit with an illumination means movable between a stowed position and a deployed position.

U.S. Pat. No. 4,908,742, Kersey, describes a portable writing box constructed to resemble a small brief case so that it can be easily carried. The box opens to uncover a writing surface illuminated along three edges such that a writer's hand or arm does not cast a shadow on the area being written upon. The light is not enclosed.

U.S. Pat. No. 1,767,156, Smith, discloses a resonant shadeless desk for use by musicians who require light directed upon their music sheets while avoiding rays of light from the desk extending toward an audience. This desk is enclosed on all surfaces except the one facing the musician. A light installed in the interior portion provides illumination for the music sheets on the desk. This resonant desk is of a unitary structure and shape and contains a unitary base such that the entire structure is resonant. This device is not portable.

U.S. Pat. No. 2,926,593, Bills is directed to a box used for retouching, inspecting and dusting photographic negatives. This negative retouching box is enclosed and contains a light and fan. The purpose of this box is to provide direct or diffused light upon a photographic negative and also provide filtered dust-free air to pass across its surface to remove dust particles from the negative so that the photographer can examine the negative for defects. The reason for having an enclosed structure is to safeguard the negative and the interior of the box against dust contamination during the retouching process. This invention is not easily portable, nor is there any disclosure of protecting against escaping light.

U.S. Pat. No. 2,104,223, Feinberg, covers a utility cabinet to be placed at the side of a bed and contains a light therein to illuminate the interior without disturbing any of the other occupants in the room. The device appears to be designed for use in a hospital to provide light for physicians to make notes and to hold medication or smoker's articles.

U.S. Pat. No. 2,501,840, Bradford, discloses a map holder which would be fixed onto an automobile dashboard. Specifically, the device provides illumination for a road map which can be easily accessed by the driver of an automobile. This invention is intended for use by the driver.

There are presently no products which provide a lighted work area enclosed to confine the light to the work area for a passenger in a motor vehicle. It is desirable to provide such a lighted work area so that a motor vehicle passenger can utilize the work area for reading or writing while traveling at night without interfering with the vehicle driver's vision.

SUMMARY OF THE INVENTION

An object of this invention is to provide a lighted lap-desk for facilitating reading or writing by a motor vehicle passenger while traveling at night. Another object of this invention is to provide a lighted lap-desk with a cover for confining the light to the desk area. Other objects and a better understanding of the invention can be had from the following description taken in conjunction with the drawings.

The objects of this invention can be attained by a lap-desk comprising a base; a cover; and a light, the light being located in the cover and the cover being attached to the base to form a work area within which light rays are confined.

An advantage of this invention is that the enclosed, lighted lap-desk can be utilized by a motor vehicle passenger while traveling at night without interfering with the vision of the vehicle's driver. This invention is particularly useful for parents with small children who are consistently faced with the problem of keeping the children entertained on long road trips. As evening and night arrive it is no longer possible to allow the sun to provide light to the child's books, drawing pad, etc. This invention allows the children to be entertained thereby extending the number of miles the family can travel in a day.

DETAILED DESCRIPTION OF THE PREFERRED EMBODIMENT

Figure 1:
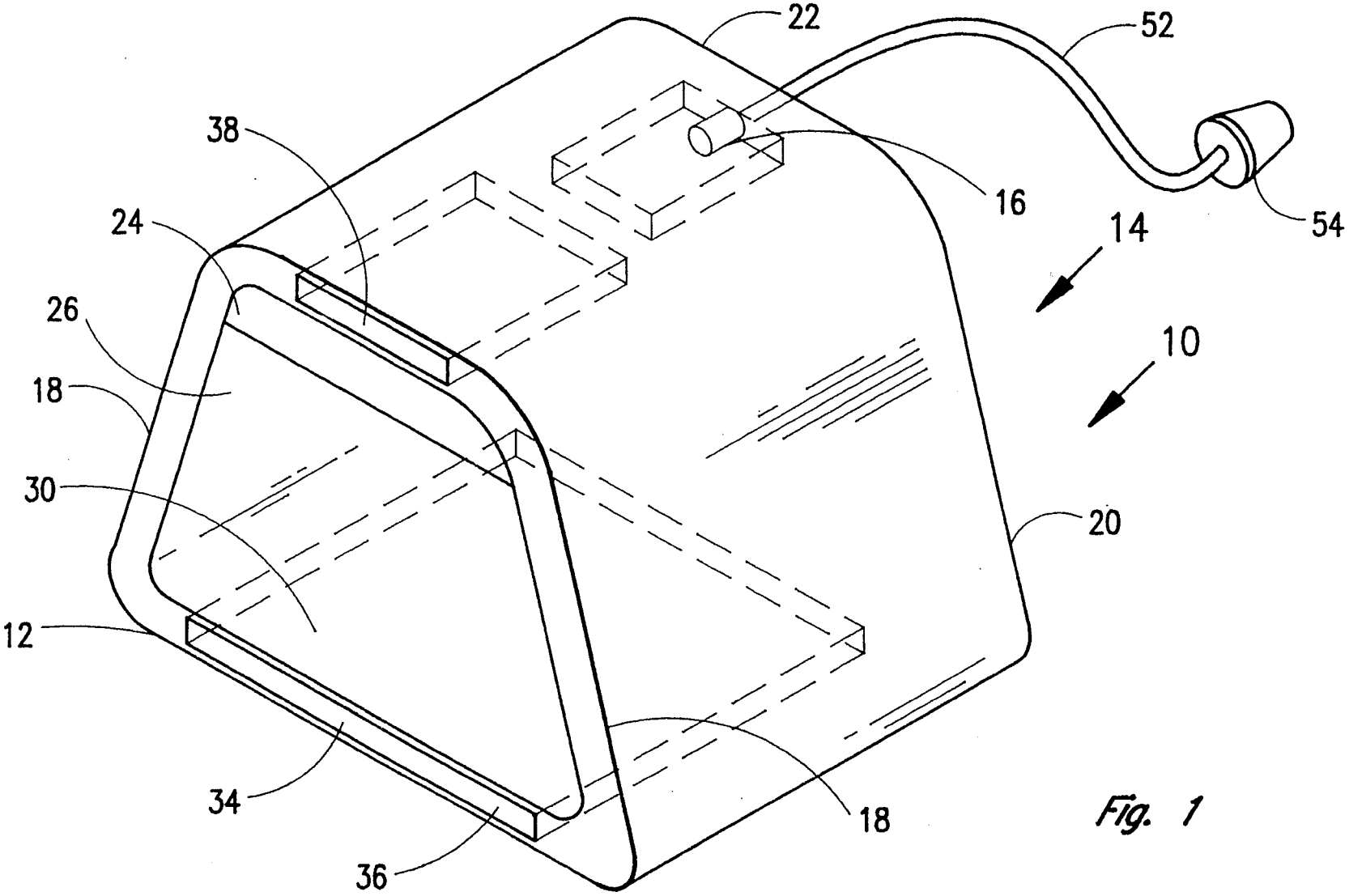
FIG. 1 is a perspective view of the enclosed, lighted lap-desk of this invention with storage compartments in the desk and enclosure.

Referring to FIG. 1, the lap-desk 10 of this invention comprises a base 12, an enclosure 14, and a light 16. The enclosure 14 is attached to the base 12 and comprises two side walls 18, a rear wall 20, a top portion 22, and a front wall 24 with an opening 26 therethrough. Front wall 24 could be omitted. The light 16 is preferably located substantially in the center of the top portion 22 of the cover 14.

Although the two side walls 18 in the embodiment of the enclosure 14 in FIG. 1 angle toward one another toward top portion 22, they could also be positioned parallel to one another to form a rectangular, box-shaped structure. It is conceivable that the enclosure could be of any other suitable geometric structure and the invention accomplish its intended purpose.

In somewhat greater detail, the base 12 is suitable for use as a writing surface 30 or as a support for reading material. To prevent light rays from passing through the base 12, the base 12 is constructed either of an opaque material or a material treated to become opaque. Preferably, the material of construction of the base 12 is sufficiently light-weight and the shape suitable for the lap-desk 10 to be held comfortably on a person's lap. For example, the base 12 can be a square or a rectangle constructed of lightweight, rigid material.

The enclosure 14 functions to confine light rays from the light 16 to the work area of the base 12 and can be constructed of a material similar to or the same as that used in constructing the base 12. Base 12 and enclosure 14 may be of unitary construction of a light weight material such as plastic. The material of construction of enclosure 14 is opaque or is treated to become opaque for preventing passage therethrough of light rays.

In the preferred position, the light 16 is located substantially in the center of the top portion 22 of the enclosure 14 to provide even diffusion of light throughout enclosure 14. However, light 16 may be positioned anywhere within enclosure 14 where specific concentration of light is desired. In this embodiment, the light 16 is an electric light, such as a 12 volt DC auto dome light, with a 2-conductor power cord 52 with a plug 54 capable of insertion into the automobile cigarette lighter. The 2-conductor cord 52 is sufficiently long to extend from the rear seat of an automobile to the dashboard of the automobile where the cigarette lighter is located, for example about 9 feet long. In a particular embodiment of this invention, the power cord 52 is detachable from light 16 so that the cord can be detached when light 16 is not in use. Light 16 may also be battery operated with a battery pack recessed in top portion 22 of enclosure 14.

In this embodiment, the area of the front wall 24 adjacent the top portion 22 serves the purpose of shielding the user of the lap-desk 10 from direct light from light 16. The opening 26 through the front wall 24 provides access to the interior surface 30 of the base 12 so that the user of the lap desk 10 can utilize the interior surface 30 for writing or reading.

In this particular embodiment of this invention, the enclosure 14 is a dome having a front 24 with an opening 26 therethrough. The base 12 has a base storage compartment 34 therein suitable for storage of pencils, paper, or the detachable cord for the light 16. The base storage compartment 34 can be a drawer within the base 12 or it can be a recess into the base 12 hidden from view by a lid 36 on a plastic hinge. Enclosure 14 includes a top storage compartment 38 suitable for storage of pens and pencils.

Figure 2:
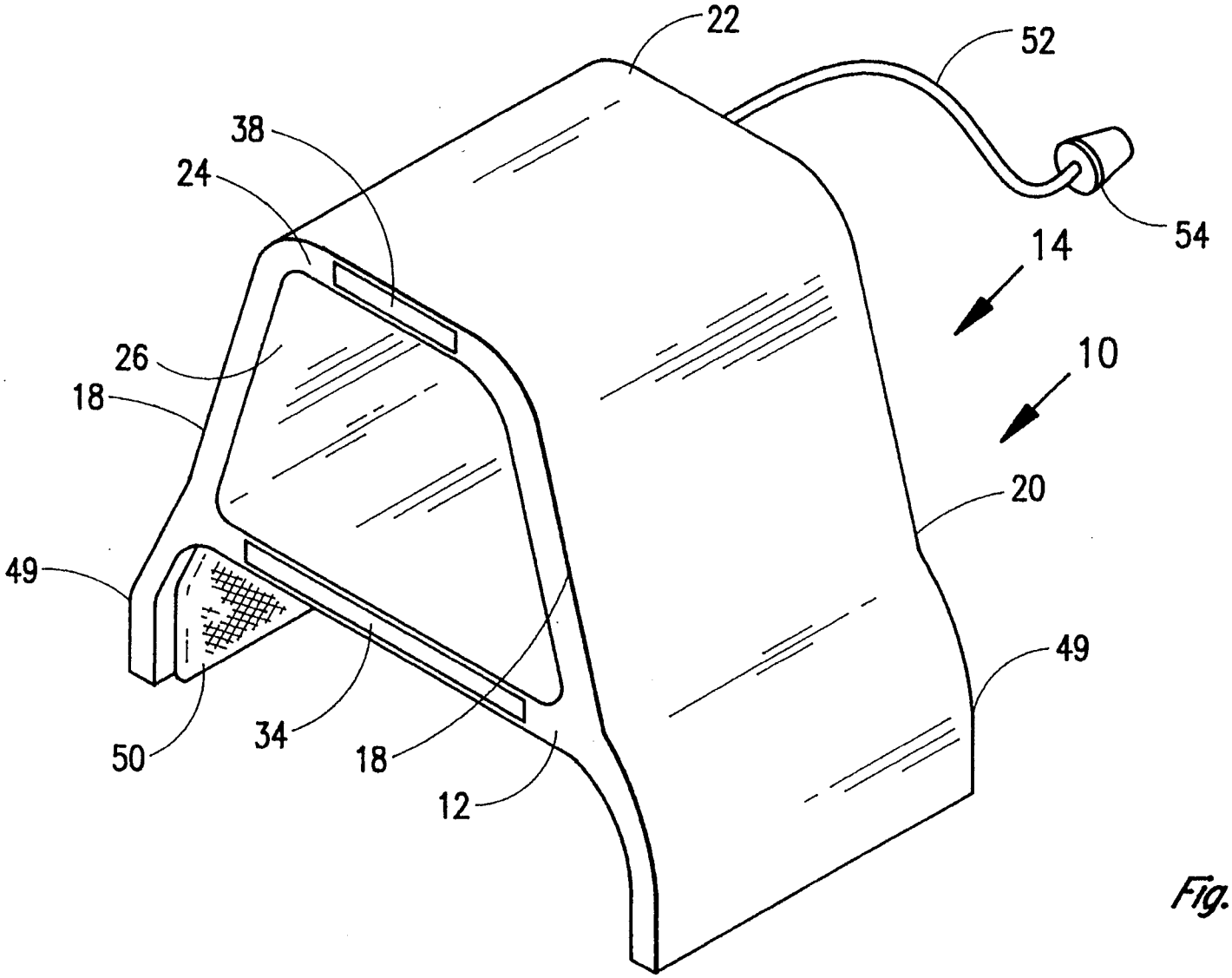
FIG. 2 is a perspective view of an embodiment of the enclosed, lighted lap-desk with storage compartments and a base portion padded and molded to have a contour to fit a seated passenger's lap.

The embodiment depicted in FIG. 2 is substantially the same as that depicted in FIG. 1 with enclosed lap-desk 10 including base 12, enclosure 14, side walls 18, rear wall 20, top portion 22, front wall 24, opening 26, base storage compartment 34, and top storage compartment 38. FIG. 2 is illustrated to show that the light is recessed into enclosure 14 to provide light inside opening 26 but would be hidden from outside view. Power cord 52 would therefore extend from rear wall 20 and would be of sufficient length so that plug 54 could be inserted into a vehicle cigarette lighter. Power cord 52 could be eliminated altogether by using a battery operated light with batteries recessed in enclosure 14.

The embodiment of FIG. 2 includes two side contoured portions 49 extending downward from side walls 18. Contoured portions 49 are of a shape to accommodate the lap of a seated passenger in a vehicle. Contoured portions 49 could either be of sufficient length to rest on the vehicle seat and thereby support lap-desk 10 or shorter to the contour of the passenger's lap in order to distribute the weight of lap-desk 10 for added comfort to the passenger. Contoured portions 49 also provide stability to lap-desk 10 as it is on the passenger's lap. Further stability could be provided to any embodiment of the device by removably securing it to the passenger's seat or the back of the seat in front of the passenger if the device is used in the rear seat. In order to provide further comfort to the passenger, a cushioned or non-slip pad 50 may be secured to the bottom of lap-desk 10.

Figure 3:
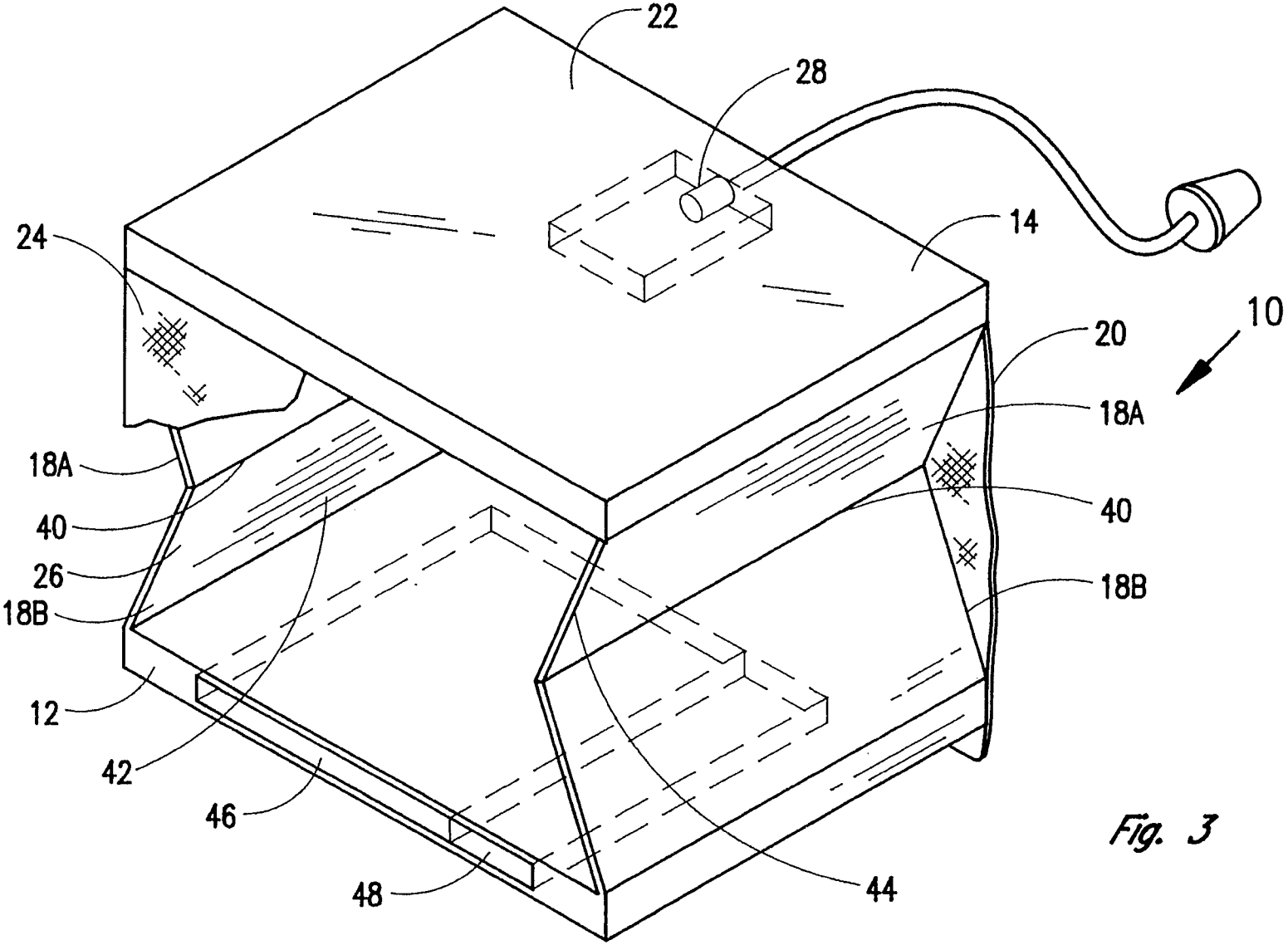
FIG. 3 is a perspective view of an embodiment of the enclosed, lighted lap-desk wherein the enclosure is comprised of inwardly collapsible side walls.

FIG. 3 illustrates an embodiment of this invention designed to be folded so that it can be easily carried and stored. The two side walls 18 are designed to fold inwardly into the enclosure 14. Each side wall 18 has a top portion 18A and a lower portion 18B with hinge 40 connecting the top and lower portions for facilitating the inward folding. When side walls 18 are folded inwardly, top portion 22 falls flat with base 12. The hinged portion 40 can be a hinged locking rod which locks in place when the enclosure 14 is unfolded for use.

In a particular embodiment, the inner portion 42 of the side walls 18 are constructed of white fabric and the outer portions 44 of the side walls 18 are constructed of black fabric. In this particular embodiment, the rear wall 20 is constructed of a pliable material, such as a fabric. The rear wall 20 can be removably secured and sealed to the edges of the top portion 22, the two side walls 18, and the base 12 with any suitable fastner such as snaps, buttons or loop and hook. Alternatively, rear wall 20 may be made of an opaque flexible cloth and secured to top portion 22 and base 12 so that when side walls 18 are folded inward, rear wall 20 is likewise folded inward. Rear wall 20 is then removably secured to side walls 18 to permit folding.

The front 24 is constructed of a fabric which is attached to the edge of the top portion 22. This attachment, likewise, may be made with any suitable fastner.

The base storage compartment 34 of this embodiment has a first subcompartment 46, which is sufficiently large to hold paper and pencils, and a second subcompartment 48, which is sufficiently large to hold the detachable 2-conductor power cord and an extra bulb for the light 28. Another feature of this embodiment is that the light 28 is recessed into the top portion 22 of the enclosure 14. A switch, included with the light 28, automatically shuts off the light 28 when the lap-desk 10 is not held substantially level.

It should be understood that the use of this device is not confined to passengers of motor vehicles and could be useful in other settings where one desires to have a rigid, lighted reading or writing surface where the light may be contained from disturbing others. One such alternate application would be in a roommate situation such as a college dorm where one student wishes to study while the other wishes to sleep.

While the invention has been described with a certain degree of particularity, it is manifest that many changes may be made in the details of construction and the arrangement of components without departing from the spirit and scope of the disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A portable lap-desk, comprising:

a flat base having a perimeter to be supported on the lap of a passenger in a vehicle; an opaque enclosure including at least two side walls, a rear wall opposite the passenger and connected to said side walls, and a top portion connected to two side walls and said rear wall; a light, the light being located and mounted in the opaque enclosure, and the opaque enclosure being attached to the flat base around its perimeter on at least three sides to form a work area in which light rays from the light are confined.

2. A lap-desk as described in claim 1 wherein the top portion contains the light.

3. A lap-desk as described in claim 1 in which said two side walls, said rear wall and said top portion formed a dome, a dome and a front wall attached to said top portion, the front wall having an opening therethrough.

4. A lap-desk as described in claim 3 in which the flat base includes at least three sides and a base storage compartment which opens on a side of the flat base parallel to the front wall and toward the passenger.

5. A lap-desk as described in claim 3 in which the opaque enclosure includes an enclosure storage compartment.

6. A lap-desk as described in claim 1 in which the light is connected by an electrical cord terminating with a plug configured to electrically connect with an automobile cigarette lighter.

7. A lap-desk as described in claim 6 wherein the electrical cord is detachable from the light.

* * * * *